US010022603B2

(12) United States Patent
Wakabayashi et al.

(10) Patent No.: US 10,022,603 B2
(45) Date of Patent: Jul. 17, 2018

(54) GOLF CLUB SHAFT AND GOLF CLUB PROVIDED WITH THE SAME

(71) Applicant: Fujikura Rubber Ltd., Koto-ku, Tokyo (JP)

(72) Inventors: Masaki Wakabayashi, Saitama (JP); Yoshihito Kogawa, Saitama (JP)

(73) Assignee: FUJIKURA RUBBER LTD., Tokyo (JP)

( * ) Notice: Subject to any disclaimer, the term of this patent is extended or adjusted under 35 U.S.C. 154(b) by 109 days.

(21) Appl. No.: 15/105,929

(22) PCT Filed: Jan. 14, 2016

(86) PCT No.: PCT/JP2016/050925

§ 371 (c)(1),
(2) Date: Jun. 17, 2016

(87) PCT Pub. No.: WO2017/122308

PCT Pub. Date: Jul. 20, 2017

(65) Prior Publication Data

US 2018/0043223 A1 Feb. 15, 2018

(51) Int. Cl.
*A63B 53/10* (2015.01)

(52) U.S. Cl.
CPC ..... *A63B 53/10* (2013.01); *A63B 2209/023* (2013.01)

(58) Field of Classification Search
CPC ..... A63B 53/10
See application file for complete search history.

(56) References Cited

U.S. PATENT DOCUMENTS 8,936,516 B2 * 1/2015 Yashiki ..... A63B 53/10 473/319
2002/0052249 A1 5/2002 Oyama
2002/0119830 A1 * 8/2002 Jackson ..... A63B 53/10 473/316
2013/0035177 A1 * 2/2013 Wakabayashi ..... A63B 53/10 473/319

FOREIGN PATENT DOCUMENTS

JP 10-015130 A 1/1998
JP 10-151690 A 6/1998
(Continued)

OTHER PUBLICATIONS

International Search Report for Application No. PCT/JP2016/050925, dated Feb. 23, 2016.

*Primary Examiner* — Michael Dennis
(74) *Attorney, Agent, or Firm* — McCormick, Paulding & Huber LLP

(57) ABSTRACT

A golf club shaft and a golf club using such a golf club shaft are achieved, wherein the golf club shaft is capable of suppressing variations of various parameters at impact by reducing the difference in rigidity between the layers of the shaft body. The golf club shaft includes full-length bias prepregs provided only as a plurality of pairs thereof and as full-length layers that extend over an entire length of the shaft body, wherein fiber directions of each pair of the full-length bias prepregs are inclined at an angle within a range of 22 degrees through 28 degrees relative to a longitudinal direction of the shaft body, respectively.

12 Claims, 8 Drawing Sheets

| NUMBER | MATERIAL OF PREPREG | ANGLE (°) | SHEET WEIGHT (g) | SHAPE OF PREPREG |
|---|---|---|---|---|
| M | METAL | – | 6.07 | |
| 10A | CARBON | 0 | 1.90 | |
| 10B | CARBON | +25 | 11.36 | |
| 10C | CARBON | -25 | 11.36 | |
| 10D | CARBON | +25 | 11.86 | |
| 10E | CARBON | -25 | 11.86 | |
| 10F | CARBON | +25 | 12.79 | |
| 10G | CARBON | -25 | 12.79 | |
| 10H | CARBON | 0 | 6.05 | |

| | | |
|---|---|---|
| TOTAL WEIGHT | 86.0g | 80.0g |
| BIAS LAYER | 72.0g | 72.0g |
| RATIO | 83.7% | 90.1% |
| | METAL CYLINDER INCLUDED | METAL CYLINDER EXCLUDED |

(56) References Cited

FOREIGN PATENT DOCUMENTS

| | | | |
|---|---|---|---|
| JP | 2001-204865 | A | 7/2001 |
| JP | 2002-085608 | A | 3/2002 |
| JP | 2002-347148 | A | 12/2002 |
| JP | 2007-307169 | A | 11/2007 |
| JP | 2009-254601 | A | 11/2009 |
| JP | 2013-027606 | A | 2/2013 |
| WO | 2012070253 | A1 | 5/2012 |

* cited by examiner

| NUMBER | MATERIAL OF PREPREG | ANGLE (°) | SHEET WEIGHT (g) | SHAPE OF PREPREG |
|---|---|---|---|---|
| M | METAL | – | 6.07 | |
| 10A | CARBON | 0 | 1.90 | |
| 10B | CARBON | +25 | 11.36 | |
| 10C | CARBON | -25 | 11.36 | |
| 10D | CARBON | +25 | 11.86 | |
| 10E | CARBON | -25 | 11.86 | |
| 10F | CARBON | +25 | 12.79 | |
| 10G | CARBON | -25 | 12.79 | |
| 10H | CARBON | 0 | 6.05 | |

INNER LAYER (LOWER LAYER) ← → OUTER LAYER (UPPER LAYER)

| | | |
|---|---|---|
| TOTAL WEIGHT | 86.0g | 80.0g |
| BIAS LAYER | 72.0g | 72.0g |
| RATIO | 83.7% | 90.1% |
| | METAL CYLINDER INCLUDED | METAL CYLINDER EXCLUDED |

| NUMBER | MATERIAL OF PREPREG | ANGLE (°) | SHEET WEIGHT (g) | SHAPE OF PREPREG |
|---|---|---|---|---|
| M | METAL | – | 13.25 | |
| 20A | CARBON | 0 | 1.90 | |
| 20B | CARBON | +25 | 10.70 | |
| 20C | CARBON | -25 | 10.70 | |
| 20D | CARBON | +25 | 12.12 | |
| 20E | CARBON | -25 | 12.12 | |
| 20F | CARBON | +25 | 13.53 | |
| 20G | CARBON | -25 | 13.53 | |
| 20H | CARBON | +25 | 13.53 | |
| 20I | CARBON | -25 | 13.53 | |
| 20J | CARBON | 0 | 5.62 | |

| | | |
|---|---|---|
| TOTAL WEIGHT | 120.5g | 107.3g |
| BIAS LAYER | 99.8g | 99.8g |
| RATIO | 82.8% | 93.0% |
| | METAL CYLINDER INCLUDED | METAL CYLINDER EXCLUDED |

Fig. 3

SMALL-DIAMETER DISTAL END SIDE (TIP SIDE) ⟷ LARGE-DIAMETER PROXIMAL END SIDE (BUTT SIDE)

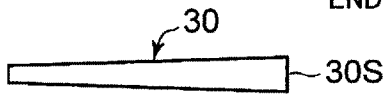

INNER LAYER (LOWER LAYER) ↑ ↕ ↓ OUTER LAYER (UPPER LAYER)

| NUMBER | MATERIAL OF PREPREG | ANGLE (°) | SHEET WEIGHT (g) | SHAPE OF PREPREG |
|---|---|---|---|---|
| M | METAL | – | 6.07 | |
| 30A | CARBON | +25 | 1.90 | |
| 30B | CARBON | +25 | 11.36 | |
| 30C | CARBON | -25 | 11.36 | |
| 30D | CARBON | +25 | 11.86 | |
| 30E | CARBON | -25 | 11.86 | |
| 30F | CARBON | +25 | 12.79 | |
| 30G | CARBON | -25 | 12.79 | |
| 30H | CARBON | +25 | 6.05 | |

| | | |
|---|---|---|
| TOTAL WEIGHT | 86.0g | 80.0g |
| BIAS LAYER | 80.0g | 80.0g |
| RATIO | 93.0% | 100.0% |
| | METAL CYLINDER INCLUDED | METAL CYLINDER EXCLUDED |

Fig. 4

SMALL-DIAMETER DISTAL END SIDE (TIP SIDE) ⟷ LARGE-DIAMETER PROXIMAL END SIDE (BUTT SIDE)

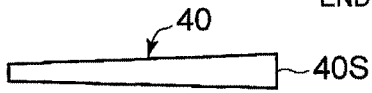

INNER LAYER (LOWER LAYER) ↑ ↓ OUTER LAYER (UPPER LAYER)

| NUMBER | MATERIAL OF PREPREG | ANGLE (°) | SHEET WEIGHT (g) | SHAPE OF PREPREG |
|---|---|---|---|---|
| M | METAL | – | 13.25 | |
| 40A | CARBON | +25 | 1.90 | |
| 40B | CARBON | +25 | 10.70 | |
| 40C | CARBON | -25 | 10.70 | |
| 40D | CARBON | +25 | 12.12 | |
| 40E | CARBON | -25 | 12.12 | |
| 40F | CARBON | +25 | 13.53 | |
| 40G | CARBON | -25 | 13.53 | |
| 40H | CARBON | +25 | 13.53 | |
| 40I | CARBON | -25 | 13.53 | |
| 40J | CARBON | +25 | 5.62 | |

| | | |
|---|---|---|
| TOTAL WEIGHT | 120.5g | 107.3g |
| BIAS LAYER | 107.3g | 107.3g |
| RATIO | 89.0% | 100.0% |
| | METAL CYLINDER INCLUDED | METAL CYLINDER EXCLUDED |

| NUMBER | MATERIAL OF PREPREG | ANGLE (°) | SHEET WEIGHT (g) | SHAPE OF PREPREG |
|---|---|---|---|---|
| M | METAL | – | 6.07 | |
| 50A | CARBON | 0 | 1.68 | |
| 50B | CARBON | +45 | 27.33 | |
| 50C | CARBON | -45 | 27.33 | |
| 50D | CARBON | 0 | 8.08 | |
| 50E | CARBON | 0 | 15.79 | |
| 50F | CARBON | 0 | 1.27 | |

| | | |
|---|---|---|
| TOTAL WEIGHT | 87.5g | 81.5g |
| BIAS LAYER | 54.7g | 54.7g |
| RATIO | 62.4% | 67.1% |
| | METAL CYLINDER INCLUDED | METAL CYLINDER EXCLUDED |

Fig. 6

SMALL-DIAMETER DISTAL END SIDE (TIP SIDE) ⟷ LARGE-DIAMETER PROXIMAL END SIDE (BUTT SIDE)

60

60S

INNER LAYER (LOWER LAYER)

OUTER LAYER (UPPER LAYER)

| NUMBER | MATERIAL OF PREPREG | ANGLE (°) | SHEET WEIGHT (g) | SHAPE OF PREPREG |
|---|---|---|---|---|
| M | METAL | – | 13.25 | |
| 60A | CARBON | 0 | 2.13 | |
| 60B | CARBON | +45 | 22.38 | |
| 60C | CARBON | -45 | 22.38 | |
| 60D | CARBON | +45 | 16.61 | |
| 60E | CARBON | -45 | 16.61 | |
| 60F | CARBON | 0 | 9.42 | |
| 60G | CARBON | 0 | 8.28 | |
| 60H | CARBON | 0 | 10.16 | |
| 60I | CARBON | 0 | 1.27 | |

| | | |
|---|---|---|
| TOTAL WEIGHT | 122.5g | 109.2g |
| BIAS LAYER | 78.0g | 78.0g |
| RATIO | 63.7% | 71.4% |
| | METAL CYLINDER INCLUDED | METAL CYLINDER EXCLUDED |

Fig. 7A

AVERAGE VALUES OVER 10 SHOT

| | | HEAD SPEED [m/s] | BALL SPEED [m/s] | LAUNCH ANGLE[deg] | BACK SPIN [rpm] | MAXIMUM HEIGHT [yds] | CARRY [yds] |
|---|---|---|---|---|---|---|---|
| TESTER A | EMBODIMENT | 30.9 | 34.7 | 29.1 | 9632 | 20.4 | 92.8 |
| TESTER B | | 27.2 | 27.7 | 31.7 | 7878 | 14.0 | 66.7 |
| TESTER C | | 31.3 | 34.7 | 32.2 | 9888 | 23.0 | 91.7 |
| TESTER D | | 32.9 | 36.5 | 27.2 | 10403 | 21.0 | 99.3 |
| TESTER E | | 28.3 | 33.1 | 30.2 | 8519 | 19.3 | 86.9 |
| AVERAGE VALUE | | 30.1 | 33.3 | 30.1 | 9264 | 19.5 | 87.5 |
| TESTER A | COMPARATIVE EX. | 31.6 | 34.3 | 28.7 | 9931 | 19.6 | 91.3 |
| TESTER B | | 27.0 | 27.4 | 31.8 | 7868 | 13.7 | 65.0 |
| TESTER C | | 31.5 | 34.4 | 31.9 | 9911 | 22.4 | 90.7 |
| TESTER D | | 33.0 | 36.1 | 26.7 | 10221 | 20.0 | 97.4 |
| TESTER E | | 28.3 | 32.4 | 31.3 | 8493 | 19.3 | 83.9 |
| AVERAGE VALUE | | 30.3 | 32.9 | 30.1 | 9285 | 19.0 | 85.7 |

Fig. 7B

DISPERSION

| | | HEAD SPEED [m/s] | BALL SPEED [m/s] | LAUNCH ANGLE[deg] | BACK SPIN [rpm] | MAXIMUM HEIGHT[yds] | CARRY [yds] |
|---|---|---|---|---|---|---|---|
| TESTER A | EMBODIMENT | 1.0 | 1.3 | 3.0 | 460 | 4.0 | 4.7 |
| TESTER B | | 1.3 | 3.2 | 4.3 | 1460 | 4.0 | 12.0 |
| TESTER C | | 2.3 | 2.0 | 3.9 | 980 | 4.3 | 7.4 |
| TESTER D | | 0.8 | 2.1 | 4.1 | 1070 | 4.0 | 8.0 |
| TESTER E | | 1.3 | 2.3 | 5.3 | 490 | 6.3 | 9.3 |
| AVERAGE VALUE | | 1.3 | 2.2 | 4.1 | 892 | 4.5 | 8.3 |
| TESTER A | COMPARATIVE EX. | 1.6 | 2.9 | 3.3 | 830 | 4.4 | 10.7 |
| TESTER B | | 1.6 | 3.7 | 8.7 | 1660 | 9.1 | 15.9 |
| TESTER C | | 2.0 | 2.8 | 4.6 | 1130 | 6.8 | 9.8 |
| TESTER D | | 1.5 | 2.5 | 9.2 | 2900 | 8.8 | 9.4 |
| TESTER E | | 1.5 | 4.3 | 10.2 | 1120 | 11.2 | 16.5 |
| AVERAGE VALUE | | 1.6 | 3.3 | 7.2 | 1528 | 8.1 | 12.5 |

GOLF CLUB SHAFT AND GOLF CLUB PROVIDED WITH THE SAME

CROSS-REFERENCE TO RELATED APPLICATION

This application is entitled to the benefit of and incorporates by reference subject matter disclosed in the International Patent Application No. PCT/JP2016/050925 filed on Jan. 14, 2016.

TECHNICAL FIELD

The present invention relates to a golf club shaft and a golf club provided with the same.

BACKGROUND ART

Golf club shafts with a shaft body which is formed by thermally curing a plurality of prepregs made of reinforced fibers impregnated with a thermosetting resin are conventionally known in the art.

Full-length 0-degree prepregs (full-length 0-degree layers), whose fiber directions are substantially parallel to the longitudinal direction of the shaft body, full-length 90-degree prepregs (full-length 90-degree layers), whose fiber directions are substantially orthogonal to the longitudinal direction of the shaft body, and full-length 45-degree prepregs (full-length 45-degree layers), whose fiber directions are inclined at 45 degrees relative to the longitudinal direction of the shaft body, are commonly known prepregs.

The full-length 0-degree layers function as bending-rigidity holding layers that are responsible for rigidity against bending, the full-length 90-degree layers function as crushing rigidity holding layers that are responsible for rigidity against crushing, and the full-length 45-degree layers function as torsional rigidity holding layers that are responsible for rigidity against torsion.

SUMMARY

In conventional golf club shafts, emphasis of the development thereof has been put on how these prepregs that are mutually different in fiber direction are to be combined to attain desired properties. However, according to extensive research carried out by the inventors, in the above-described conventional golf club shafts, the full-length 0-degree layers, the full-length 90-degree layers and the full-length 45-degree layers influence rigidities in different directions, which inevitably causes a difference in rigidity at the boundaries (interfaces) between these layers, and this has been proven to be a cause of variations of various parameters upon ball impact such as club head speed, ball speed, launch angle, back spin, maximum height and carry.

The present invention has been devised in view of the above described problems, and an object of the present invention is to achieve a golf club shaft and a golf club using such a golf club shaft, wherein the golf club shaft can suppress variations of various parameters upon ball impact by reducing the difference in rigidity between the layers of the shaft body.

The inventors of the present invention have achieved the present invention, through extensive research, based on the findings that if only pairs of bias layers of specific angles are used as full-length layers that extend over the entire length of the shaft instead of the conventional combined use of 0-degree, 90-degree and 45-degree layers, the difference in rigidity between layers is small; moreover, bending rigidity, crushing rigidity and torsional rigidity can be optimally set in a well-balanced manner.

The golf club shaft, according to the present invention, provided with a shaft body formed by thermally curing a plurality of prepregs made of reinforced fibers impregnated with a thermosetting resin, is provided, the golf club shaft including full-length bias prepregs provided only as a plurality of pairs thereof and as full-length layers that extend over an entire length of the shaft body, wherein fiber directions of each pair of the full-length bias prepregs are inclined at an angle within a range of 22 degrees through 28 degrees relative to a longitudinal direction of the shaft body, respectively.

The plurality of pairs of the full-length bias prepregs can be identical in specification.

The golf club shaft according to the present invention can further include a partial 0-degree prepreg, a fiber direction of which is substantially parallel to the longitudinal direction of the shaft body, as a partial layer which constitutes a portion of the shaft body in the longitudinal direction of the shaft body.

The golf club shaft according to present invention can further include a weighting cylinder which is positioned at a portion of the shaft body in the longitudinal direction of the shaft body.

A ratio of weight of the pairs of full-length bias prepregs to a total weight of the golf club shaft including the metal cylinder can be one of equal to and greater than 82 percent, and/or a ratio of the weight of the pairs of full-length bias prepregs to a total weight of the golf club shaft excluding the metal cylinder can be one of equal to and greater than 90 percent.

The golf club shaft according to the present invention can further include a partial bias prepreg, a fiber direction of which is inclined at an angle within a range of 22 degrees through 28 degrees relative to the longitudinal direction of the golf club shaft, as a partial layer which constitutes a portion of the shaft body in the longitudinal direction of the shaft body.

The golf club shaft according to the present invention can further include a weighting cylinder which is positioned at a portion of the shaft body in the longitudinal direction of the shaft body.

A ratio of a total weight of the pairs of full-length bias prepregs and the partial bias prepreg to a total weight of the golf shaft including the metal cylinder can be one of equal to and greater than 88 percent, and/or a ratio of the total weight of the pairs of full-length bias prepregs and the partial bias prepreg to a total weight of the golf shaft excluding the metal cylinder can be 100 percent.

The pairs of full-length bias prepregs can be configured of three or four pairs of full-length bias prepregs.

A golf club according to the present invention can be configured of the above-described golf club shaft with a golf club head and a grip fixed thereto.

According to the present invention, a golf club shaft capable of suppressing variations of various parameters upon ball impact by reducing the difference in rigidity between the layers of the shaft body and a golf club using such a golf club shaft can be secured.

BRIEF DESCRIPTION OF DRAWINGS

FIG. 3 is a diagram illustrating the structure of a third embodiment of the golf club shaft.

FIG. 4 is a diagram illustrating the structure of a fourth embodiment of the golf club shaft.

FIG. 6 is a diagram illustrating the structure of a second comparative example of a golf club shaft.

FIG. 7A is a table showing average values of various parameters upon testers executing impacting tests on the second embodiment of the golf club shaft and on the second comparative example of the golf club shaft.

FIG. 7B is a table showing dispersion of the various parameters upon testers executing impacting tests on the second embodiment of the golf club shaft and on the second comparative example of the golf club shaft.

DETAILED DESCRIPTION

Figure 1:
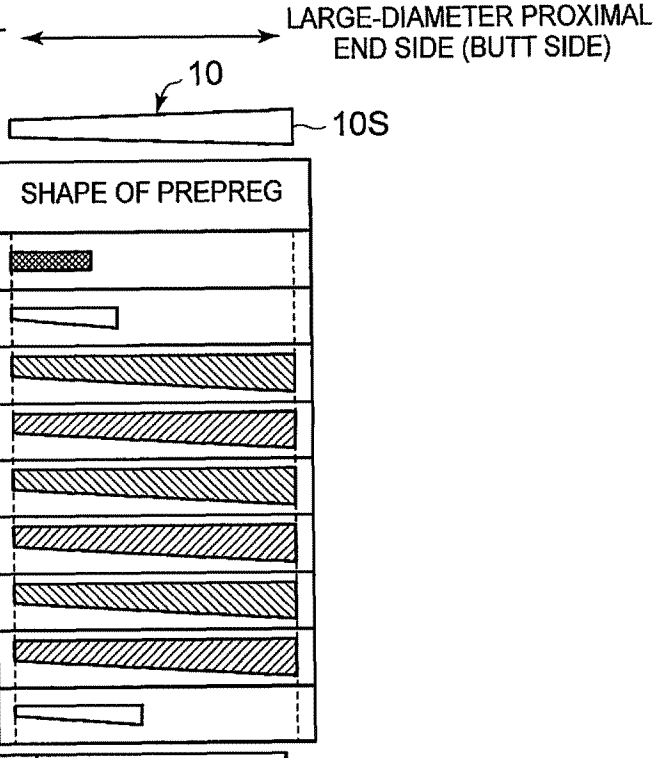
FIG. 1 is a diagram illustrating the structure of a first embodiment of a golf club shaft.

FIG. 1 illustrates a first embodiment of a golf club shaft 10. The golf club shaft 10 is formed into a tapered tube which progressively increases in outer diameter from the small-diameter distal end side (tip side) toward the large-diameter proximal end side (butt side). A club head (not shown) is fixed to the small-diameter distal-end of the golf club shaft 10, while a grip (not shown) is fixed to the large-diameter proximal end of the golf club shaft 10, thereby forming a golf club.

The golf club shaft 10 is provided with a shaft body 10S which is formed by thermally curing a plurality of prepregs made of reinforced fibers (carbon fibers in this embodiment) impregnated with a thermosetting resin. More specifically, the shaft body 10S is formed by winding prepregs 10A through 10H around a tapered mandrel (not shown), in that order from the inner layer (lower layer) toward the outer layer (upper layer), and thermally curing the same. A metal cylinder (weighting cylinder) M, which is positioned on the distal end side of the shaft body 10S (at a portion thereof in the longitudinal direction) to apply a weight on this distal end side portion, is provided (embedded) at the innermost layer (the lowest layer) of the shaft body 10S.

The prepreg 10A and the prepreg 10H, which are positioned on the inner layer side and the outer layer side, respectively, are partial 0-degree prepregs, the fiber directions of which are substantially parallel to the longitudinal direction of the shaft body 10S (the longitudinal direction of the shaft). The partial 0-degree prepreg 10A on the inner layer side serves as a reinforcing layer (a partial layer which constitutes part of the shaft in the longitudinal direction of the shaft) which reinforces the distal end of the shaft body 10S, and the partial 0-degree prepreg 10H on the outer layer side serves as a partial layer (a partial layer which constitutes part of the shaft in the longitudinal direction of the shaft) which constitutes substantially half of the shaft body 10S on the distal end side.

The prepregs 10B through 10G are full-length prepregs which extend over the entire length of the shaft body 10S. The prepregs 10B through 10G are each formed into a trapezoidal shape which narrows toward the small-diameter distal end from the large-diameter distal end so that the ply number is the same along the entire length of each prepreg when wound on the mandrel (not shown).

More specifically, the prepregs 10B and 10C constitute a first pair of full-length bias prepregs whose fiber directions are inclined at ±25 degrees relative to the longitudinal direction of the shaft, respectively, the prepregs 10D and 10E constitute a second pair of full-length bias prepregs whose fiber directions are inclined at ±25 degrees relative to the longitudinal direction of the shaft, respectively, and the prepregs 10F and 10G constitute a third pair of full-length bias prepregs whose fiber directions are inclined at ±25 degrees relative to the longitudinal direction of the shaft, respectively.

The full-length prepregs, which constitute elements of the golf club shaft 10 (the shaft body 10S), consist solely of three pairs full-length prepregs: the first pair of full-length bias prepregs (10B, 10C), the second pair of full-length bias prepregs (10D, 10E) and the third pair of full-length bias prepregs (10F, 10G); these three pairs of full-length bias prepregs are all identical in specification (identical fiber angles are set as target angles though a certain degree of deviation may possibly occur due to factors such as manufacturing error).

The first pair of full-length bias prepregs (10B, 10C), the second pair of full-length bias prepregs (10D, 10E) and the third pair of full-length bias prepregs (10F, 10G) are increasingly greater in sheet weight in that order. This is because the winding amount is smaller as the prepreg is positioned closer to the inner layer side and greater as the prepreg is positioned closer to the outer layer side (the difference in sheet weight is not attributed to the difference in specification).

The ratio of the weight (approximately 72.0 grams) of the three pairs of full-length bias prepregs (10B through 10G) to the total weight (approximately 86.0 grams) of the shaft including the metal cylinder M is approximately 83.7 percent. The ratio of the weight (approximately 72.0 grams) of the three pairs of full-length bias prepregs (10B through 10G) to the total weight (approximately 80.0 grams) of the shaft excluding the metal cylinder M is approximately 90.1 percent.

Figure 2:
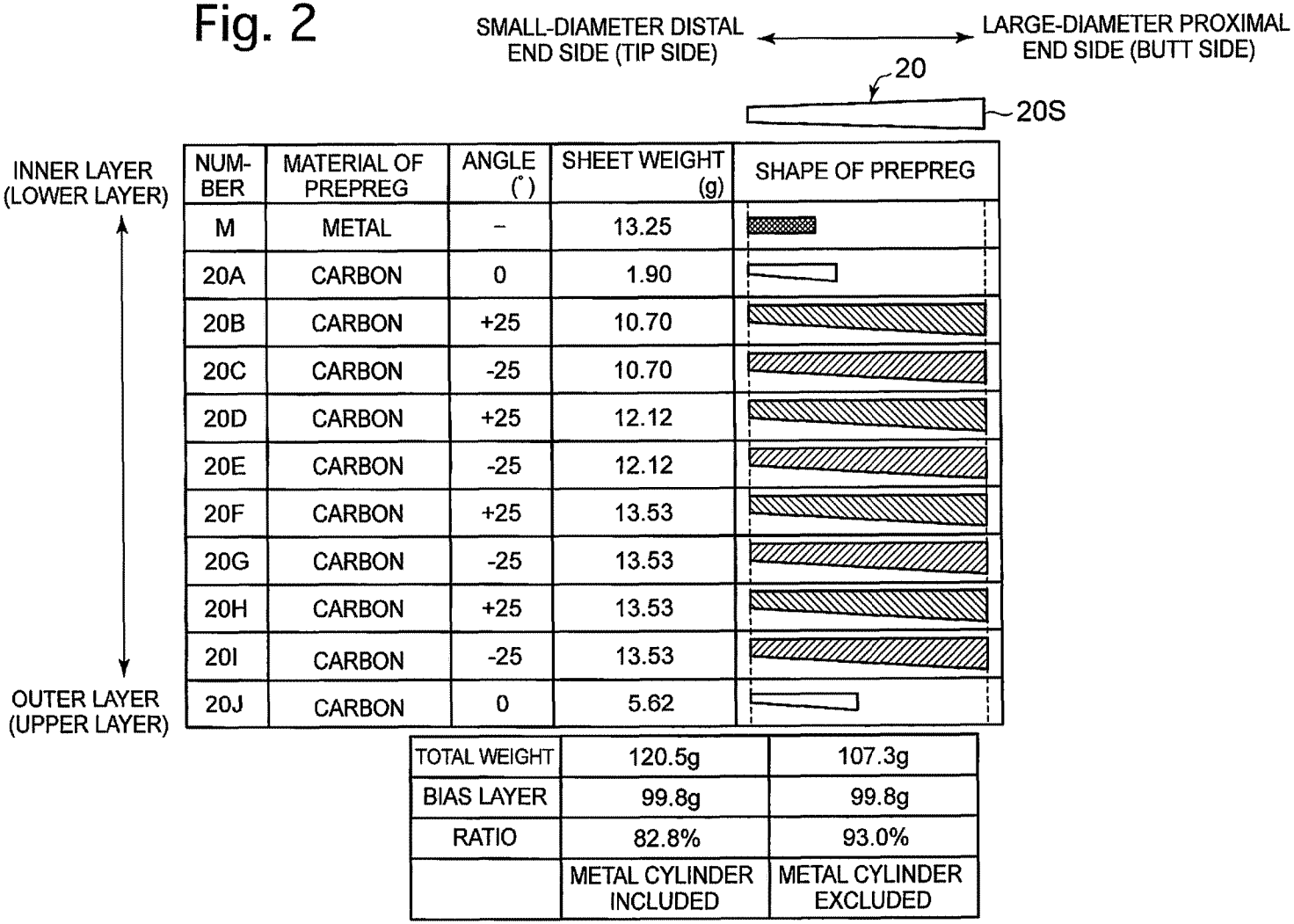
FIG. 2 is a diagram illustrating the structure of a second embodiment of the golf club shaft.

FIG. 2 illustrates a second embodiment of the golf club shaft 20. The golf club shaft 20 is provided with a shaft body 20S which is formed by thermally curing a plurality of prepregs made of reinforced fibers (carbon fibers in this embodiment) impregnated with a thermosetting resin. More specifically, the shaft body 20S is formed by winding prepregs 20A through 20J around a tapered mandrel (not shown), in that order from the inner layer (lower layer) toward the outer layer (upper layer) and thermally curing the same. A metal cylinder (weighting cylinder) M, which is positioned on the distal end side of the shaft body 20S (at a portion thereof in the longitudinal direction) to apply a weight on this distal end portion, is provided (embedded) at the innermost layer (the lowest layer) of the shaft body 20S.

The prepreg 20A and the prepreg 20J, which are positioned on the inner layer side and the outer layer side, respectively, are partial 0-degree prepregs, the fiber directions of which are substantially parallel to the longitudinal direction of the shaft body 20S (the longitudinal direction of the shaft). The partial 0-degree prepreg 20A on the inner layer side serves as a reinforcing layer (a partial layer which constitutes part of the shaft in the longitudinal direction of the shaft) which reinforces the distal end of the shaft body 20S, and the partial 0-degree prepreg 20J on the outer layer side serves as a partial layer (a partial layer which constitutes part of the shaft in the longitudinal direction of the shaft) which constitutes substantially half of the shaft body 20S on the distal end side.

The prepregs 20B through 20I are full-length prepregs which extend over the entire length of the shaft body 20S. The prepregs 20B through 20I are each formed into a trapezoidal shape which narrows toward the small-diameter distal end from the large-diameter distal end so that the ply number is the same along the entire length of each prepreg when wound on the mandrel (not shown).

More specifically, the prepregs 20B and 20C constitute a first pair of full-length bias prepregs whose fiber directions are inclined at ±25 degrees relative to the longitudinal direction of the shaft, respectively, the prepregs 20D and 20E constitute a second pair of full-length bias prepregs whose fiber directions are inclined at ±25 degrees relative to the longitudinal direction of the shaft, respectively, the prepregs 20F and 20G constitute a third pair of full-length bias prepregs whose fiber directions are inclined at ±25 degrees relative to the longitudinal direction of the shaft, respectively, and prepregs 20H and 20I constitute a fourth pair of full-length bias prepregs whose fiber directions are inclined at ±25 degrees relative to the longitudinal direction of the shaft, respectively.

The full-length prepregs, which constitute elements of the golf club shaft 20 (the shaft body 20S), consist solely of four pairs full-length prepregs: the first pair of full-length bias prepregs (20B, 20C), the second pair of full-length bias prepregs (20D, 20E), the third pair of full-length bias prepregs (20F, 20G) and the fourth pair of full-length bias prepregs (20H, 20I), and these fourth pairs of full-length bias prepregs are all identical in specification (identical fiber angles are set as target angles though a certain degree of deviation may possibly occur due to factors such as manufacturing error).

The first pair of full-length bias prepregs (20B, 20C), the second pair of full-length bias prepregs (20D, 20E), the third pair of full-length bias prepregs (20F, 20G) and the fourth pair of full-length bias prepregs (20H, 20I) are increasingly greater in sheet weight in that order. This is because the winding amount is smaller as the prepreg is positioned closer to the inner layer side and greater as the prepreg is position closer to the outer layer side (the difference in sheet weight is not attributed to the difference in specification). In addition, the third pair of full-length bias prepregs (20F, 20G) and the fourth pair of full-length bias prepregs (20H, 20I) are mutually identical in sheet weight.

The ratio of the weight (approximately 99.8 grams) of the four pairs of full-length bias prepregs (20B through 20I) to the total weight (approximately 120.5 grams) of the shaft including the metal cylinder M is approximately 82.8 percent. The ratio of the weight (approximately 99.8 grams) of the four pairs of full-length bias prepregs (20B through 20I) to the total weight (approximately 107.3 grams) of the shaft excluding the metal cylinder M is approximately 93.0 percent.

FIG. 3 illustrates a third embodiment of the golf club shaft 30. The golf club shaft 30 is provided with a shaft body 30S which is formed by thermally curing a plurality of prepregs made of reinforced fibers (carbon fibers in this embodiment) impregnated with a thermosetting resin. More specifically, the shaft body 30S is formed by winding prepregs 30A through 30H around a tapered mandrel (not shown), in that order from the inner layer (lower layer) toward the outer layer (upper layer) and thermally curing the same. A metal cylinder (weighting cylinder) M which is positioned on the distal end side of the shaft body 30S (at a portion thereof in the longitudinal direction) to apply a weight on this distal end portion is provided (embedded) at the innermost layer (the lowest layer) of the shaft body 30S.

The prepreg 30A and the prepreg 30H, which are positioned on the inner layer side and the outer layer side, respectively, are partial bias prepregs, the fiber directions of which are inclined at 25 degrees relative to the longitudinal direction of the shaft body 30S (the longitudinal direction of the shaft). The partial bias prepreg 30A on the inner layer side serves as a reinforcing layer (a partial layer which constitutes part of the shaft in the longitudinal direction of the shaft) which reinforces the distal end of the shaft body 30S, and the partial bias prepreg 30H on the outer layer side serves as a partial layer (a partial layer which constitutes part of the shaft in the longitudinal direction of the shaft) which constitutes substantially half of the shaft body 30S on the distal end side.

The prepregs 30B through 30G are full-length prepregs which extend over the entire length of the shaft body 30S. The prepregs 30B through 30G are each formed into a trapezoidal shape which narrows toward the small-diameter distal end from the large-diameter distal end so that the ply number is the same along the entire length of each prepreg when wound on the mandrel (not shown).

More specifically, the prepregs 30B and 30C constitute a first pair of full-length bias prepregs whose fiber directions are inclined at ±25 degrees relative to the longitudinal direction of the shaft, respectively, the prepregs 30D and 30E constitute a second pair of full-length bias prepregs whose fiber directions are inclined at ±25 degrees relative to the longitudinal direction of the shaft, respectively, and the prepregs 30F and 30G constitute a third pair of full-length bias prepregs whose fiber directions are inclined at ±25 degrees relative to the longitudinal direction of the shaft, respectively.

The full-length prepregs which constitute elements of the golf club shaft 30 (the shaft body 30S) consist solely of three pairs full-length prepregs: the first pair of full-length bias prepregs (30B, 30C), the second pair of full-length bias prepregs (30D, 30E) and the third pair of full-length bias prepregs (30F, 30G), and these three pairs of full-length bias prepregs are all identical in specification (identical fiber angles are set as target angles though a certain degree of deviation may possibly occur due to factors such as manufacturing error). Whereas, the prepregs of the partial bias prepregs (30A, 30H) can use a different thickness(es) and carbon type(s) from that of the three pairs of full-length bias prepregs (30B through 30G).

The first pair of full-length bias prepregs (30B, 30C), the second pair of full-length bias prepregs (30D, 30E) and the third pair of full-length bias prepregs (30F, 30G) are increasingly greater in sheet weight in that order. This is because the winding amount is smaller as the prepreg is positioned closer to the inner layer side and greater as the prepreg is position closer to the outer layer side (the difference in sheet weight is not attributed to the difference in specification).

The ratio of the total weight (approximately 80.0 grams) of the partial bias prepregs (30A, 30H) and the three pairs of full-length bias prepregs (30B through 30G) to the total weight (approximately 86.0 grams) of the shaft including the metal cylinder M is approximately 93.0 percent. The ratio of the total weight (approximately 80.0 grams) of the partial bias prepregs (30A, 30H) and the three pairs of full-length bias prepregs (30B through 30G) to the total weight (approximately 80.0 grams) of the shaft excluding the metal cylinder M is 100 percent.

FIG. 4 illustrates a fourth embodiment of the golf club shaft 40. The golf club shaft 40 is provided with a shaft body 40S which is formed by thermally curing a plurality of prepregs made of reinforced fibers (carbon fibers in this embodiment) impregnated with a thermosetting resin. More specifically, the shaft body 40S is formed by winding prepregs 40A through 40J around a tapered mandrel (not shown), in that order from the inner layer (lower layer) toward the outer layer (upper layer) and thermally curing the same. A metal cylinder (weighting cylinder) M which is positioned on the distal end side of the shaft body 40S (at a portion thereof in the longitudinal direction) to apply a weight on this distal end portion is provided (embedded) at the innermost layer (the lowest layer) of the shaft body 40S.

The prepreg 40A and the prepreg 40J, which are positioned on the inner layer side and the outer layer side, respectively, are partial bias prepregs, the fiber directions of which are inclined at 25 degrees relative to the longitudinal direction of the shaft body 40S (the longitudinal direction of the shaft). The partial bias prepreg 40A on the inner layer side serves as a reinforcing layer (a partial layer which constitutes part of the shaft in the longitudinal direction of the shaft) which reinforces the distal end of the shaft body 40S, and the partial bias prepreg 40J on the outer layer side serves as a partial layer (a partial layer which constitutes part of the shaft in the longitudinal direction of the shaft) which constitutes substantially half of the shaft body 40S on the distal end side.

The prepregs 40B through 40I are full-length prepregs which extend over the entire length of the shaft body 40S. The prepregs 40B through 40I are each formed into a trapezoidal shape which narrows toward the small-diameter distal end from the large-diameter distal end so that the ply number is the same along the entire length of each prepreg when wound on the mandrel (not shown).

More specifically, the prepregs 40B and 40C constitute a first pair of full-length bias prepregs whose fiber directions are inclined at ±25 degrees relative to the longitudinal direction of the shaft, respectively, the prepregs 40D and 40E constitute a second pair of full-length bias prepregs whose fiber directions are inclined at ±25 degrees relative to the longitudinal direction of the shaft, respectively, the prepregs 40F and 40G constitute a third pair of full-length bias prepregs whose fiber directions are inclined at ±25 degrees relative to the longitudinal direction of the shaft, respectively, and the prepregs 40H and 40I constitute a fourth pair of full-length bias prepregs whose fiber directions are inclined at ±25 degrees relative to the longitudinal direction of the shaft, respectively.

The full-length prepregs which constitute elements of the golf club shaft 40 (the shaft body 40S) consist solely of fourth pairs full-length prepregs: the first pair of full-length bias prepregs (40B, 40C), the second pair of full-length bias prepregs (40D, 40E), the third pair of full-length bias prepregs (40F, 40G) and the fourth pair of full-length bias prepregs (40H, 40I), and these four pairs of full-length bias prepregs are all identical in specification (identical fiber angles are set as target angles though a certain degree of deviation may possibly occur due to factors such as manufacturing error). Whereas, the prepregs of the partial bias prepregs (40A, 40J) can use a different thickness(es) and carbon type(s) from that of the four pairs of full-length bias prepregs (40B through 40I).

The first pair of full-length bias prepregs (40B, 40C), the second pair of full-length bias prepregs (40D, 40E), the third pair of full-length bias prepregs (40F, 40G) and the fourth pair of full-length bias prepregs (40H, 40I) are increasingly greater in sheet weight in that order. This is because the winding amount is smaller as the prepreg is positioned closer to the inner layer side and greater as the prepreg is position closer to the outer layer side (the difference in sheet weight is not attributed to the difference in specification). In addition, the third pair of full-length bias prepregs (40F, 40G) and the fourth pair of full-length bias prepregs (40H, 40I) are mutually identical in sheet weight.

The ratio of the total weight (approximately 107.3 grams) of the partial bias prepregs (40A, 40J) and the four pairs of full-length bias prepregs (40B through 40I) to the total weight (approximately 120.5 grams) of the shaft including the metal cylinder M is approximately 89.0 percent. The ratio of the total weight (approximately 107.3 grams) of the partial bias prepregs (40A, 40J) and the four pairs of full-length bias prepregs (40B through 40I) to the total weight (approximately 107.3 grams) of the shaft excluding the metal cylinder M is 100 percent (only bias prepregs are used; any other types of prepregs are not used).

The first through fourth embodiments of the golf club shafts 10 through 40 are provided with only three or four pairs of full-length bias prepregs (10B through 10G/20B through 20I/30B through 30G/40B through 40I) whose fiber directions of each pair are inclined at ±25 degrees relative to the longitudinal direction of the shaft, respectively, as the full-length layers of the shaft that extend over the entire length of the shaft body (10S/20S/30S/40S).

With this structure, the boundaries (interfaces) between the three or four pairs of full-length bias prepregs (10B through 10G/20B through 20I/30B through 30G/40B through 40I) are smoothly and consecutively positioned, which makes it possible to suppress variations of various parameters upon ball impact such as club head speed, ball speed, launch angle, back spin, maximum height and carry by reducing the difference in rigidity (bending rigidity/crushing rigidity/torsional rigidity) between the layers of the shaft body (10S/20S/30S/40S).

The pairs of full-length bias prepregs (10B through 10G/20B through 20I/30B through 30G/40B through 40I) are only required to be configured such that the fiber directions thereof are inclined at an angle within a range of 22 degrees through 28 degrees relative to the longitudinal direction of the shaft (a displacement of ±3 degrees is tolerated). Satisfaction of this condition makes it possible to obtain, up to a certain degree, an effect of suppressing variations of various parameters upon ball impact such as club head speed, ball speed, launch angle, back spin, maximum height and carry by reducing the difference in rigidity between the layers of the shaft body (10S/20S/30S/40S).

If the absolute value of the angle of the fiber direction of any of the pairs of full-length bias prepregs (10B through 10G/20B through 20I/30B through 30G/40B through 40I) exceeds the upper limit of 28 degrees, the bending rigidity becomes insufficient, which makes it impossible to obtain a desired shaft performance. In addition, if the absolute value of the angle of the fiber direction of any of the pairs of full-length bias prepregs (10B through 10G/20B through 20I/30B through 30G/40B through 40I) falls below the lower limit of 22 degrees, the torsional rigidity becomes insufficient, which makes it impossible to obtain a desired shaft performance.

In an embodiment like the first embodiment and the second embodiment in which partial 0-degree prepregs (10A and 10H, or 20A and 20J) are provided, it is desirable that the ratio of the weight of the three or four pairs of full-length bias prepregs (10B through 10G, or 20B through 20I) to the total weight of the shaft including the metal cylinder M be equal to or greater than 82 percent and/or that the ratio of the weight of the three or four pairs of full-length bias prepregs (10B through 10G, or 20B through 20I) to the total weight of the shaft excluding the metal cylinder M be equal to or greater than 90 percent.

In an embodiment like the third embodiment and the fourth embodiment in which partial bias prepregs (30A and 30H, or 40A and 40J) are provided, it is desirable that the ratio of the total weight of the partial bias prepregs (30A and 30H, or 40A and 40J) and the three or four pairs of full-length bias prepregs (30B through 30G, or 40B through 40I) to the total weight of the shaft including the metal cylinder M be equal to or greater than 88 percent and/or that the ratio of the total weight of the partial bias prepregs (30A and 30H, or 40A and 40J) and the three or four pairs of full-length bias prepregs (30B through 30G, or 40B through 40I) to the total weight of the shaft excluding the metal cylinder M be 100 percent.

As can be understood from the above, setting a high ratio of the weight of the bias prepregs, the fiber directions of which are inclined at an angle within a range of 22 degrees through 28 degrees relative to the longitudinal direction of the shaft, to the total weight of the shaft makes it possible to more remarkably exhibit the effect of suppressing variations of various parameters upon ball impact by reducing the difference in rigidity between the layers of the shaft body (10S/20S/30S/40S).

Although the cases where the three or four pairs of full-length bias prepregs (10B through 10G/20B through 20I/30B through 30G/40B through 40I) are provided have been illustrated by way of example in the above described first through fourth embodiments, the number of the pairs of full-length bias prepregs only needs to be more than one; for instance, an embodiment in which two or more than four pairs of full-length bias prepregs are provided is also possible.

Comparative Example 1

Figure 5:
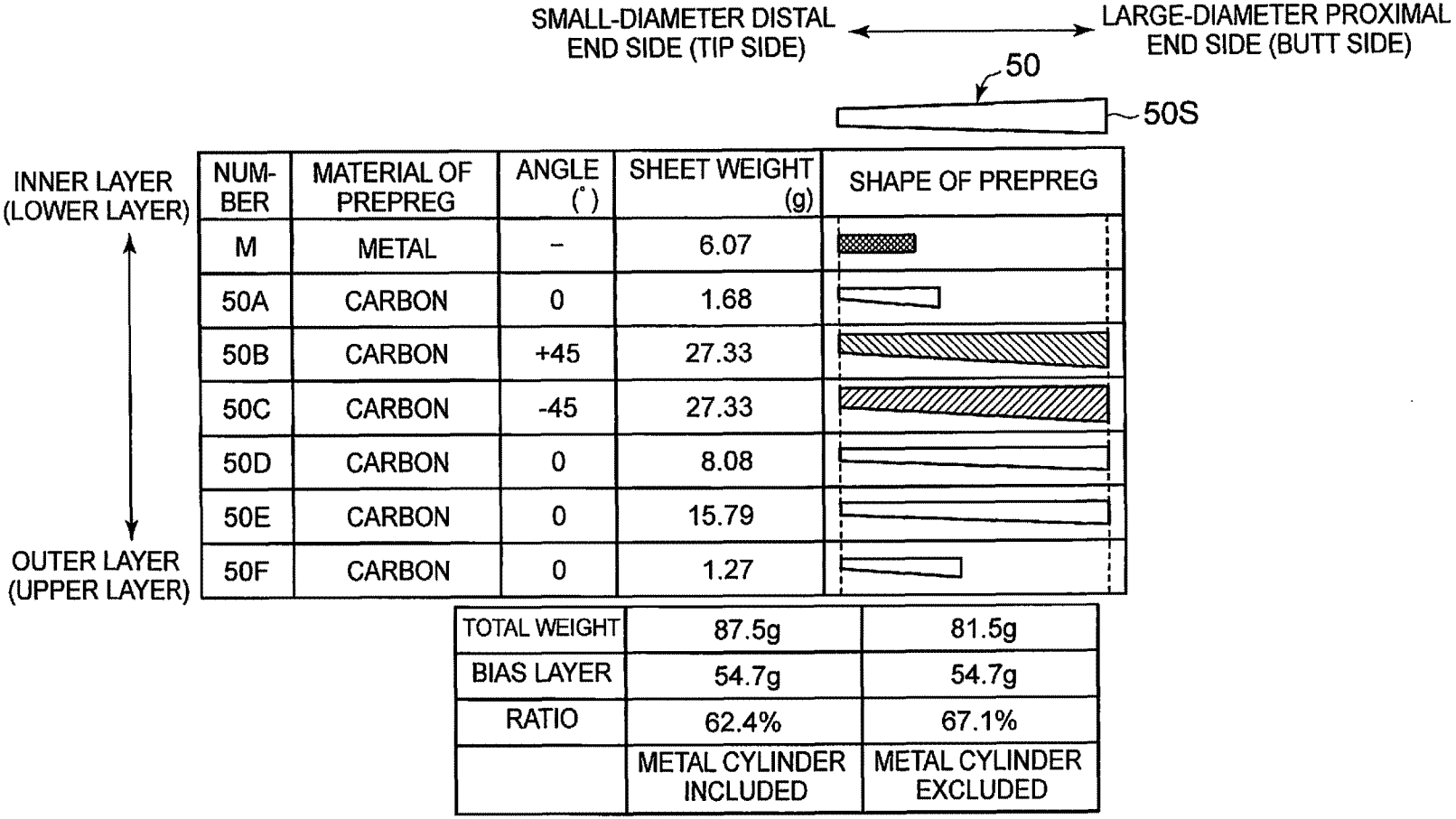
FIG. 5 is a diagram illustrating the structure of a first comparative example of a golf club shaft.

FIG. 5 shows a first comparative example of a golf club shaft 50. The golf club shaft 50 is provided with a shaft body 50S which is formed by thermally curing a plurality of prepregs made of reinforced fibers (carbon fibers in this example) impregnated with a thermosetting resin. More specifically, the shaft body 50S is formed by winding prepregs 50A through 50F around a tapered mandrel (not shown), in that order from the inner layer (lower layer) toward the outer layer (upper layer) and thermally curing the same. A metal cylinder (weighting cylinder) M which is positioned on the distal end side of the shaft body 50S (at a portion thereof in the longitudinal direction) to apply a weight on this distal end portion is provided (embedded) at the innermost layer (the lowest layer) of the shaft body 50S.

The prepreg 50A and the prepreg 50F, which are positioned on the inner layer side and the outer layer side, respectively, are partial 0-degree prepregs, the fiber directions of which are substantially parallel to the longitudinal direction of the shaft body 50S (the longitudinal direction of the shaft). The partial 0-degree prepreg 50A on the inner layer side serves as a reinforcing layer (a partial layer which constitutes part of the shaft in the longitudinal direction of the shaft) which reinforces the distal end of the shaft body 50S, and the partial 0-degree prepreg 50F on the outer layer side serves as a partial layer (a partial layer which constitutes part of the shaft in the longitudinal direction of the shaft) which constitutes substantially half of the shaft body 50S on the distal end side.

The prepregs 50B through 50E are full-length prepregs which extend over the entire length of the shaft body 50S. The prepregs 50B through 50E are each formed into a trapezoidal shape which narrows toward the small-diameter distal end from the large-diameter distal end so that the ply number is the same along the entire length of each prepreg when wound on the mandrel (not shown).

The prepregs 50B and 50C are a pair of full-length bias prepregs, the fiber directions of which are inclined at ±45 degrees relative to the longitudinal direction of the shaft, respectively. The prepregs 50D and 50E are full-length 0-degree prepregs, the fiber directions of which are substantially parallel to the longitudinal direction of the shaft.

The ratio of the weight (approximately 54.7 grams) of the pair of full-length bias prepregs 50B and 50C to the total weight (approximately 87.5 grams) of the shaft including the metal cylinder M is approximately 62.4 percent. The ratio of the weight (approximately 54.7 grams) of the pair of full-length bias prepregs 50B and 50C to the total weight (approximately 81.5 grams) of the shaft excluding the metal cylinder M is approximately 67.1 percent.

Comparative Example 2

FIG. 6 shows a second comparative example of a golf club shaft 60. The golf club shaft 60 is provided with a shaft body 60S which is formed by thermally curing a plurality of prepregs made of reinforced fibers (carbon fibers in this example) impregnated with a thermosetting resin. More specifically, the shaft body 60S is formed by winding prepregs 60A through 60I around a tapered mandrel (not shown), in that order from the inner layer (lower layer) toward the outer layer (upper layer) and thermally curing the same. A metal cylinder (weighting cylinder) M which is positioned on the distal end side of the shaft body 60S (at a portion thereof in the longitudinal direction) to apply a weight on this distal end portion is provided (embedded) at the innermost layer (the lowest layer) of the shaft body 60S.

The prepreg 60A and the prepreg 60I, which are positioned on the inner layer side and the outer layer side, respectively, are partial 0-degree prepregs, the fiber directions of which are substantially parallel to the longitudinal direction of the shaft body 60S (the longitudinal direction of the shaft). The partial 0-degree prepreg 60A on the inner layer side serves as a reinforcing layer (a partial layer which constitutes part of the shaft in the longitudinal direction of the shaft) which reinforces the distal end of the shaft body 60S, and the partial 0-degree prepreg 60I on the outer layer side serves as a partial layer (a partial layer which constitutes part of the shaft in the longitudinal direction of the shaft) which constitutes substantially half of the shaft body 60S on the distal end side.

The prepregs 60B through 60H are full-length prepregs which extend over the entire length of the shaft body 60S. The prepregs 60B through 60H are each formed into a trapezoidal shape which narrows toward the small-diameter distal end from the large-diameter distal end so that the ply number is the same along the entire length of each prepreg when wound on the mandrel (not shown).

The prepregs 60B and 60C are a pair of full-length bias prepregs, the fiber directions of which are inclined at ±45 degrees relative to the longitudinal direction of the shaft, respectively. The prepregs 60D and 60E are a pair of full-length bias prepregs, the fiber directions of which are inclined at ±45 degrees relative to the longitudinal direction of the shaft, respectively. The prepregs 60F, 60G and 60H are full-length 0-degree prepregs, the fiber directions of which are substantially parallel to the longitudinal direction of the shaft.

The ratio of the total weight (approximately 78.0 grams) of the pair of full-length bias prepregs 60B and 60C and the pair of full-length bias prepregs 60D and 60E to the total weight (approximately 122.5 grams) of the shaft including the metal cylinder M is approximately 63.7 percent. The ratio of the total weight (approximately 78.0 grams) of the pair of full-length bias prepregs 60B and 60C and the pair of full-length bias prepregs 60D and 60E to the total weight (approximately 109.2 grams) of the shaft excluding the metal cylinder M is approximately 71.4 percent.

<<Results of Impact Testing by Testers>>

The inventors of the present invention actually produced the second embodiment of the golf club shaft 20 and the second comparative example of the golf club shaft 60 and executed impacting testing, in which five testers A, B, C, D and E, which are advanced-level golfers, hit ten balls with each shaft (each tester performed ten shots on each golf club shaft). The results of this testing are shown in FIGS. 7A and 7B. FIGS. 7A and 7B show average values of club head speed [m/s], ball speed [m/s], launch angle [deg], back spin [rpm], maximum height [yds] and carry [yds], and the dispersion in these parameters. The dispersion shown in FIG. 7B is the variation of the values corresponding to the maximum values of the various parameters obtained from the ten-shot testing from which the minimum values of the same parameters obtained from the ten-shot testing are subtracted.

As shown in FIG. 7A, no great difference is seen in the average values of the various parameters upon ball impact between the second embodiment of the golf club shaft 20 and the second comparative example of the golf club shaft 60. As shown in FIG. 7B, the second embodiment of the golf club shaft 20 has a smaller dispersion in the various parameters upon ball impact than that in the comparative example of the golf club shaft 60.

INDUSTRIAL APPLICABILITY

A golf club shaft according to the present invention and a golf club using this golf club shaft are suitably used in the field of golf industry.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A golf club shaft provided with a shaft body formed by thermally curing a plurality of prepregs made of reinforced fibers impregnated with a thermosetting resin, wherein said golf club shaft comprises:

full-length bias prepregs provided only as a plurality of pairs thereof and as full-length layers that extend over an entire length of said shaft body, wherein fiber directions of each pair of said full-length bias prepregs are inclined at an angle within a range of 22 degrees through 28 degrees relative to a longitudinal direction of said shaft body, respectively;

a partial 0-degree prepreg, a fiber direction of which is substantially parallel to said longitudinal direction of said shaft body, as a partial layer which constitutes a portion of said shaft body in said longitudinal direction of said shaft body;

a weighting cylinder which is positioned at a portion of said shaft body in said longitudinal direction of said shaft body; and wherein the ratio of the weight of said pairs of full-length bias prepregs to the total weight of said golf club shaft including said metal cylinder is equal to or greater than 82 percent, or wherein a ratio of said weight of said pairs of full-length bias prepregs to a total weight of said golf club shaft excluding said metal cylinder is equal to or greater than 90 percent.

2. The golf club shaft according to claim 1, wherein the plurality of pairs of said full-length bias prepregs are identical in specification.

3. The golf club shaft according to claim 2, further comprising a partial bias prepreg, a fiber direction of which is inclined at an angle within a range of 22 degrees through 28 degrees relative to said longitudinal direction of said golf club shaft, as a partial layer which constitutes a portion of said shaft body in said longitudinal direction of said shaft body.

4. The golf club shaft according to claim 2, wherein said pairs of full-length bias prepregs comprise three or four pairs of full-length bias prepregs.

5. A golf club comprising said golf club shaft according to claim 2, to which a golf club head and a grip are fixed.

6. The golf club shaft according to claim 1, further comprising a partial bias prepreg, a fiber direction of which is inclined at an angle within a range of 22 degrees through 28 degrees relative to said longitudinal direction of said golf club shaft, as a partial layer which constitutes a portion of said shaft body in said longitudinal direction of said shaft body.

7. The golf club shaft according to claim 6, wherein the ratio of the total weight of said pairs of full-length bias prepregs and said partial bias prepreg to the total weight of said golf shaft including said metal cylinder is equal to or greater than 88 percent, or wherein the ratio of said total weight of said pairs of full-length bias prepregs and said partial bias prepreg to the total weight of said golf shaft excluding said metal cylinder is 100 percent.

8. The golf club shaft according to claim 6, wherein said pairs of full-length bias prepregs comprise three or four pairs of full-length bias prepregs.

9. The golf club shaft according to claim 1, wherein said pairs of full-length bias prepregs comprise three or four pairs of full-length bias prepregs.

10. A golf club comprising said golf club shaft according to claim 1, to which a golf club head and a grip are fixed.

11. A golf club shaft provided with a shaft body formed by thermally curing a plurality of prepregs made of reinforced fibers impregnated with a thermosetting resin, wherein said golf club shaft comprises:

full-length bias prepregs provided only as a plurality of pairs thereof and as full-length layers that extend over an entire length of said shaft body, wherein fiber directions of each pair of said full-length bias prepregs are inclined at an angle within a range of 22 degrees through 28 degrees relative to a longitudinal direction of said shaft body, respectively;

a partial bias prepreg, a fiber direction of which is inclined at an angle within a range of 22 degrees through 28 degrees relative to said longitudinal direction of said golf club shaft, as a partial layer which constitutes a portion of said shaft body in said longitudinal direction of said shaft body;

a weighting cylinder which is positioned at a portion of said shaft body in said longitudinal direction of said shaft body; and wherein the ratio of the total weight of said pairs of full-length bias prepregs and said partial bias prepreg to the total weight of said golf shaft including said metal cylinder is equal to or greater than 88 percent, or wherein the ratio of said total weight of said pairs of full-length bias prepregs and said partial bias prepreg to the total weight of said golf shaft excluding said metal cylinder is 100 percent.

12. The golf club shaft according to claim 11, wherein said pairs of full-length bias prepregs comprise three or four pairs of full-length bias prepregs.

* * * * *